US011700938B1

(12) United States Patent
Zou

(10) Patent No.: US 11,700,938 B1
(45) Date of Patent: Jul. 18, 2023

(54) SUSPENDED STORAGE RACK

(71) Applicant: SHENZHEN QINGLONG ELECTRONIC COMMERCE CO., LTD., Shenzhen (CN)

(72) Inventor: Mengtian Zou, Shenzhen (CN)

(73) Assignee: SHENZHEN QINGLONG ELECTRONIC COMMERCE CO., LTD., Shenzhen (CN)

( * ) Notice: Subject to any disclaimer, the term of this patent is extended or adjusted under 35 U.S.C. 154(b) by 0 days.

(21) Appl. No.: 17/687,633

(22) Filed: Mar. 5, 2022

(51) Int. Cl.
*A47B 55/02* (2006.01)
*A47B 43/04* (2006.01)
*A47B 47/02* (2006.01)

(52) U.S. Cl.
CPC ..... *A47B 55/02* (2013.01); *A47B 43/04* (2013.01); *A47B 47/027* (2013.01)

(58) Field of Classification Search
CPC ..... A47B 55/02; A47B 43/04; A47B 47/027; A47B 46/005
See application file for complete search history.

(56) References Cited

U.S. PATENT DOCUMENTS 222,542 A * 12/1879 Stearns ..... D06F 57/08 211/41.6
1,752,985 A * 4/1930 Huffman ..... A47F 5/13 211/181.1
2,319,470 A * 5/1943 Nobles ..... F25D 25/02 211/153
2,564,478 A * 8/1951 Harbison ..... F25D 25/02 312/351
2,620,073 A * 12/1952 Meyers ..... A47B 55/02 211/104
2,633,998 A * 4/1953 Derman ..... A47G 25/08 108/29
2,675,130 A * 4/1954 Dore ..... A47G 25/18 211/118
2,956,689 A * 10/1960 Van Der Togt ..... D06F 57/12 211/104
2,958,424 A * 11/1960 Bigatti ..... A47L 19/00 211/104
3,007,708 A * 11/1961 Ochs ..... B62B 3/002 211/187

(Continued)

FOREIGN PATENT DOCUMENTS

FR 1186450 A * 8/1959
GB 965495 A * 7/1964

*Primary Examiner* — Stanton L Krycinski
(74) *Attorney, Agent, or Firm* — Li & Cai Intellectual Property (USA) Office

(57) ABSTRACT

A suspended storage rack includes a first rack body for suspending, and a second rack body hingedly connected to a lower side of the first rack body and used for storing articles. The second rack body includes: a storage part and a first limiting part arranged on one side of the storage part and tilted upward. A middle part of the first limiting part arranged in a vertical direction is hingedly connected to the lower side of the first rack body, an upper part of the first limiting part arranged in the vertical direction is used to prevent the second rack body from being excessively expanded relative to the first rack body, and a lower part of the first limiting part arranged in the vertical direction is used to make the storage part lean against the first rack body after the second rack body is rotated upward for storage.

13 Claims, 8 Drawing Sheets

(56) References Cited

U.S. PATENT DOCUMENTS 3,027,016 A * 3/1962 Becht ..... A47B 55/02 211/153
3,125,224 A * 3/1964 Cochrane et al. ..... A47B 63/00 211/106
3,295,471 A * 1/1967 Cook ..... A47F 5/13 108/163
3,391,891 A * 7/1968 Garden ..... B60N 3/102 211/75
3,394,818 A * 7/1968 Fineberg ..... A47F 7/28 211/49.1
4,374,498 A * 2/1983 Yellin ..... A47B 55/02 403/399
4,712,692 A * 12/1987 Peinsipp ..... D06F 57/12 211/2
4,889,057 A * 12/1989 Chartrand ..... A47B 85/04 108/42
5,069,350 A * 12/1991 Wolff ..... A47F 5/0807 211/186
5,125,517 A * 6/1992 Martinell ..... B62H 3/12 211/90.03
5,133,463 A * 7/1992 Meri ..... A47F 5/13 211/175
5,421,499 A * 6/1995 Bauer ..... A47B 23/002 224/265
5,584,405 A * 12/1996 Tunzi ..... A47B 45/00 D15/89
5,653,178 A * 8/1997 Huczka ..... A47B 96/067 108/135
5,875,902 A * 3/1999 Emery ..... A47B 96/16 108/29
6,164,194 A * 12/2000 Westmoreland ..... A47J 43/18 99/449
6,189,527 B1 * 2/2001 Walsh ..... A47J 37/067 211/175
6,341,704 B1 * 1/2002 Michel, Jr. ..... A47L 19/04 211/119.011
6,497,331 B1 * 12/2002 Morandi ..... A47B 96/202 211/90.03
8,453,852 B2 * 6/2013 Raddatz ..... D06F 57/12 211/85.24
9,072,362 B2 * 7/2015 Gallup ..... A47B 96/027
9,301,671 B2 * 4/2016 Jarl ..... A47B 81/04
9,433,290 B1 * 9/2016 Davis ..... A47F 5/0068
9,648,953 B1 * 5/2017 Kuo ..... A47F 5/01
9,756,939 B1 * 9/2017 Ruiz ..... A47B 61/04
10,362,867 B2 * 7/2019 Williams ..... A47F 5/13
10,463,185 B2 * 11/2019 Ito ..... A47L 17/04
10,663,177 B2 * 5/2020 Nelson ..... F24C 15/16
2003/0051643 A1 * 3/2003 Remmers ..... A47B 55/02 108/147.17
2003/0066462 A1 * 4/2003 Getfield ..... B60N 3/004 108/134
2005/0258117 A1 * 11/2005 Drake ..... A47B 57/045 211/106
2006/0180557 A1 * 8/2006 Weinstein ..... A47B 55/02 211/90.03
2008/0283480 A1 * 11/2008 Segall ..... A47L 19/04 211/41.6
2014/0014607 A1 * 1/2014 Mikich ..... A47B 43/00 211/195
2015/0305594 A1 * 10/2015 Jarl ..... A47L 19/04 211/41.5

* cited by examiner

SUSPENDED STORAGE RACK

FIELD OF THE DISCLOSURE

The present disclosure relates to the technical field of storage racks, in particular, to a suspended storage rack.

BACKGROUND OF THE DISCLOSURE

There are more and more types of household items, so a storage rack that can rectify and place these daily necessities is needed. The design of the storage rack is very simple and generous, and in addition, it is dexterous, so it is very useful for placing household items, and the key is that it is conducive to the article access to household items without having to search very hard.

However, most of the existing suspended storage racks cannot be folded and stored, occupying space when not in use, while the rare suspended storage racks that can be folded and stored are complicated in structure and inconvenient to use, and are in urgent need of improvement.

SUMMARY OF THE DISCLOSURE

The purpose of the present disclosure is to provide a suspended storage rack in view of the defects and deficiencies of the prior art, which has the advantages of simple structure, the second rack body can be rotated and stored to save space when not in use, and the operation of rotation and storage is simple.

In order to achieve the above object, the technical solution adopted in the present disclosure is to provide a suspended storage rack, including: a first rack body for suspending, and a second rack body hingedly connected to a lower side of the first rack body and used for storing articles; wherein the second rack body includes: a storage part, and a first limiting part arranged on one side of the storage part and tilted upward; a middle part of the first limiting part arranged in a vertical direction is hingedly connected to the lower side of the first rack body, an upper part of the first limiting part arranged in the vertical direction is used to prevent the second rack body from being excessively expanded relative to the first rack body, and a lower part of the first limiting part arranged in the vertical direction is used to make the storage part lean against the first rack body after the second rack body is rotated upward for storage.

In preferred embodiments, a rotating sleeve is provided on the lower side of the first rack body, and the middle part of the first limiting part arranged in the vertical direction is provided with a rotating shaft hingedly connected to the rotating sleeve.

In preferred embodiments, the first rack body is in a shape of an inverted L.

In preferred embodiments, when the second rack body is in an unfolded state, the storage part is parallel to a horizontal plane of the first rack body.

In preferred embodiments, a mounting member is provided on the horizontal plane of the first rack body.

In preferred embodiments, the mounting member includes: a mounting piece arranged on a lower side of the horizontal plane of the first rack body, and the mounting piece is provided with at least one screw mounting hole.

In preferred embodiments, the mounting member includes: a mounting piece arranged on a lower side of the horizontal plane of the first rack body, and a removable glue arranged on a lower side of the mounting piece.

In preferred embodiments, the second rack body further includes: a second limiting part arranged on another side of the storage part and tilted upward.

In preferred embodiments, the second limiting part is perpendicular to the storage part.

In preferred embodiments, a width of the storage part is greater than a height of the first rack body.

In preferred embodiments, the second rack body further includes: a second limiting part arranged on another side of the storage part and tilted upwards.

In preferred embodiments, the second limiting part is perpendicular to the storage part.

In preferred embodiments, a width of the storage part is greater than a height of the vertical plane of the first rack body.

In preferred embodiments, the first rack body is in a shape of a grid.

In preferred embodiments, the second rack body is in a shape of a grid.

1. In the present disclosure, the second rack body is hingedly connected to the lower side of the first rack body. When it needs to be used, the second rack body is rotated and opened relative to the first rack body, and the second rack body can store articles. When it is not needed, the second rack body is directly rotated and stored on the first rack body, the operation is simple and the space is saved. In addition, the second rack body is provided with a first limiting part, and the upper part of the first limiting part in the vertical direction is used to prevent the second rack body from being excessively expanded relative to the first rack body, so that the storage part stands at a set angle when unfolded. The lower part of the first limiting part in the vertical direction is used to make the storage part lean against the first rack body after the second rack body is rotated upwards for storage, and after the second rack body is rotated and stored, the second rack body is not easy to fall.

2. In the present disclosure, the first rack body is in an inverted L shape, and this structure is convenient for the first rack body to be suspended, such as suspending on the edge of a kitchen cabinet, a table, a bed frame, and the like.

BRIEF DESCRIPTION OF THE DRAWINGS

In order to explain the embodiments of the present disclosure or the technical solutions in the prior art more clearly, the following briefly introduces the accompanying drawings that need to be used in the description of the embodiments or the prior art. Obviously, the drawings in the following description are only some embodiments of the present disclosure, and for those of ordinary skill in the art, other drawings can also be obtained from these drawings without any creative effort.

Figure 1:
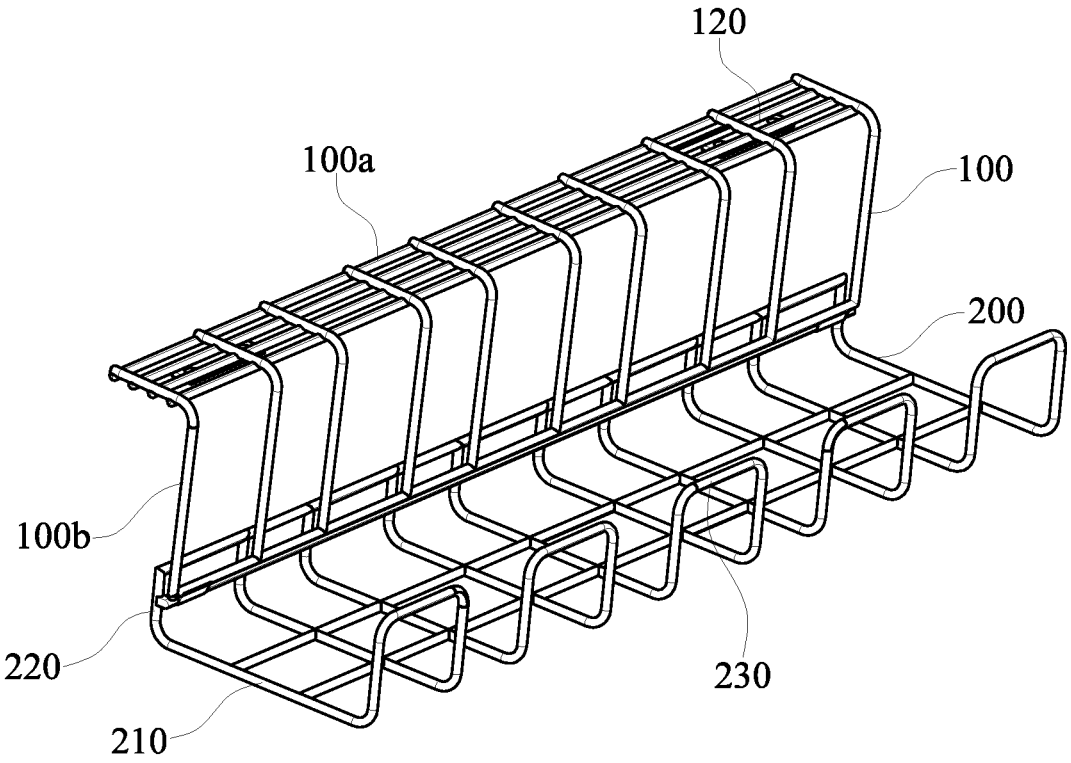
FIG. 1 is a schematic structural diagram of a second rack body in an unfolded state.

Reference numeral: 100. first rack body; 100*a*. horizontal plane; 100*b*. vertical plane; 110. rotating sleeve; 120. mounting member; 121. mounting piece; 122. screw mounting hole; 123. removable glue; 200. second rack body; 210. storage part; 220. first limiting part; 220*a*. upper part in the vertical direction; 220*b*. middle part in the vertical direction; 220*c*. lower part in the vertical direction; 230. second limiting part; 240. rotation axis.

DETAILED DESCRIPTION OF THE EXEMPLARY EMBODIMENTS

The present disclosure will be further described in detail below with reference to the accompanying drawings.

This specific embodiment is only an explanation of the present disclosure, and it is not a limitation of the present disclosure. Those skilled in the art can make modifications to this embodiment without creative contribution as needed after reading this specification, and as long as the rights of the present disclosure are used, all the claims are protected by patent law.

Embodiment 1: This embodiment relates to a suspended storage rack, as shown in FIGS. 1-5, including: a first rack body 100 for suspending and a second rack body 200 hinged on the lower side of the first rack body 100 for storing articles. When it needs to be used, the second rack body 200 is rotated and opened relative to the first rack body 100, and the second rack body 200 can be stored. When it is not needed, the second rack body 200 can be directly rotated and stored on the first rack body 100, which is simple operation and space saving.

Figure 2:
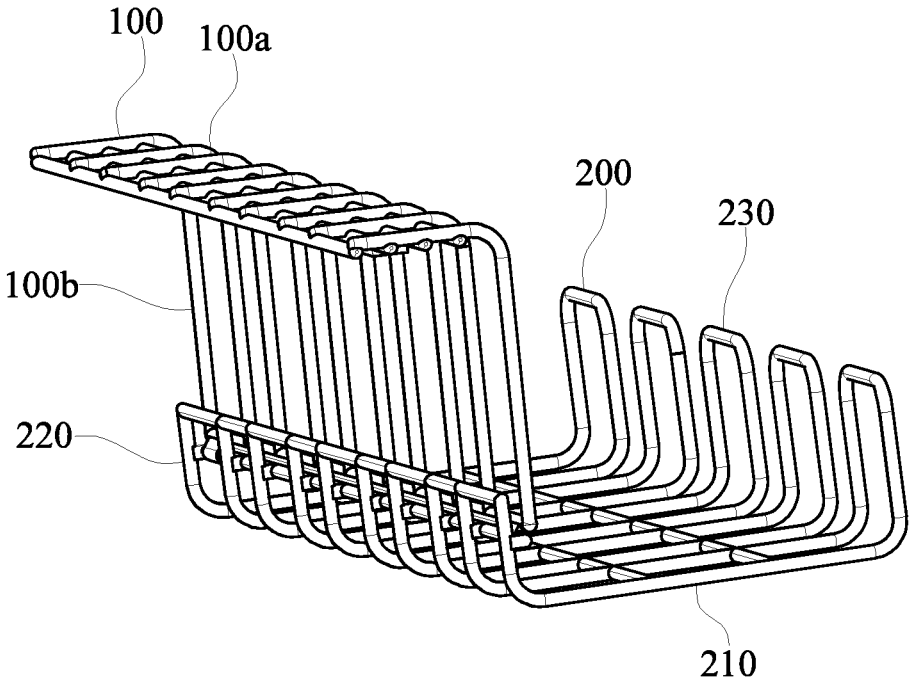
FIG. 2 is a schematic structural diagram of another perspective when the second rack body is in an unfolded state.
Figure 3:
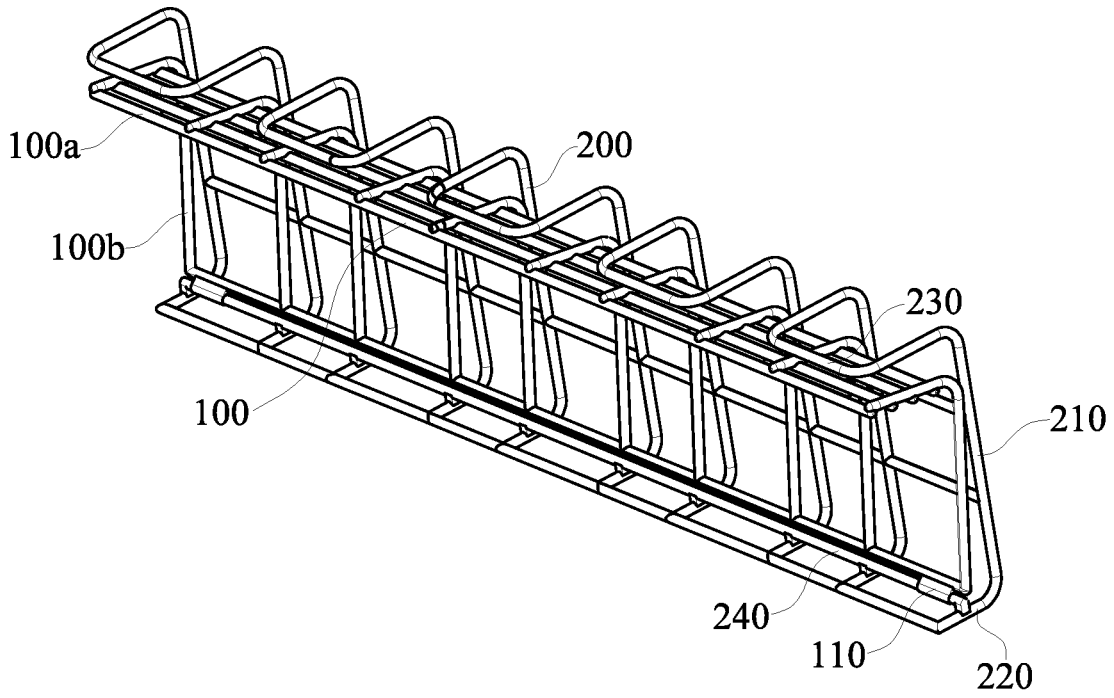
FIG. 3 is a schematic structural diagram of the second rack body in a storage state.
Figure 4:
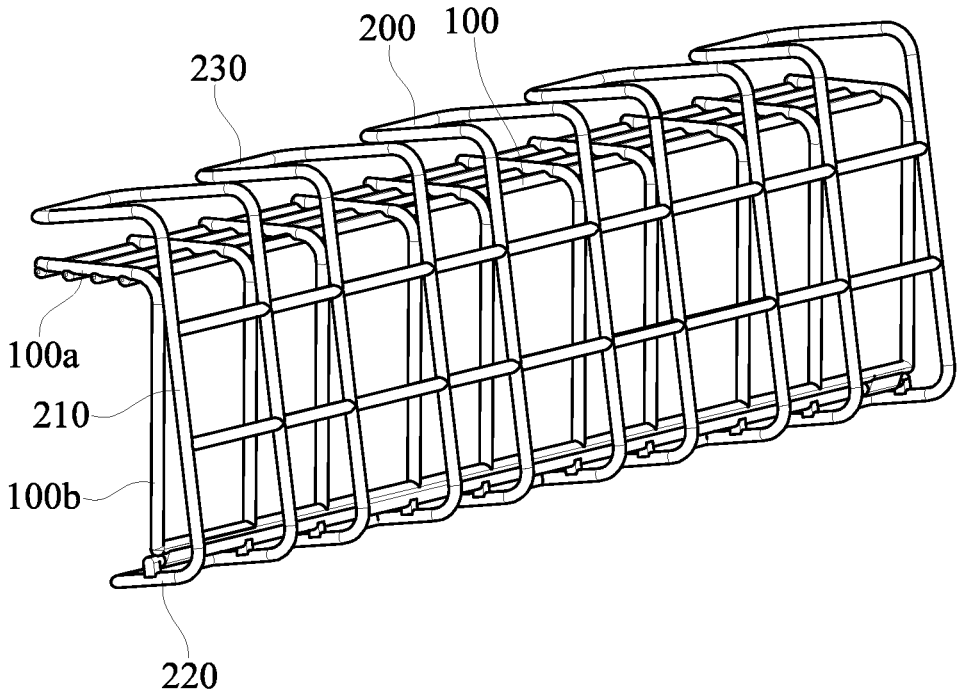
FIG. 4 is a schematic structural diagram of another perspective when the second rack body is in a storage state.

FIGS. 1 and 2 are schematic diagrams of the second rack body 200 being rotated and opened relative to the first f rack body 100, and FIGS. 3 and 4 are schematic diagrams of the second rack body 200 being rotated and stored on the first rack body 100.

Figure 5:
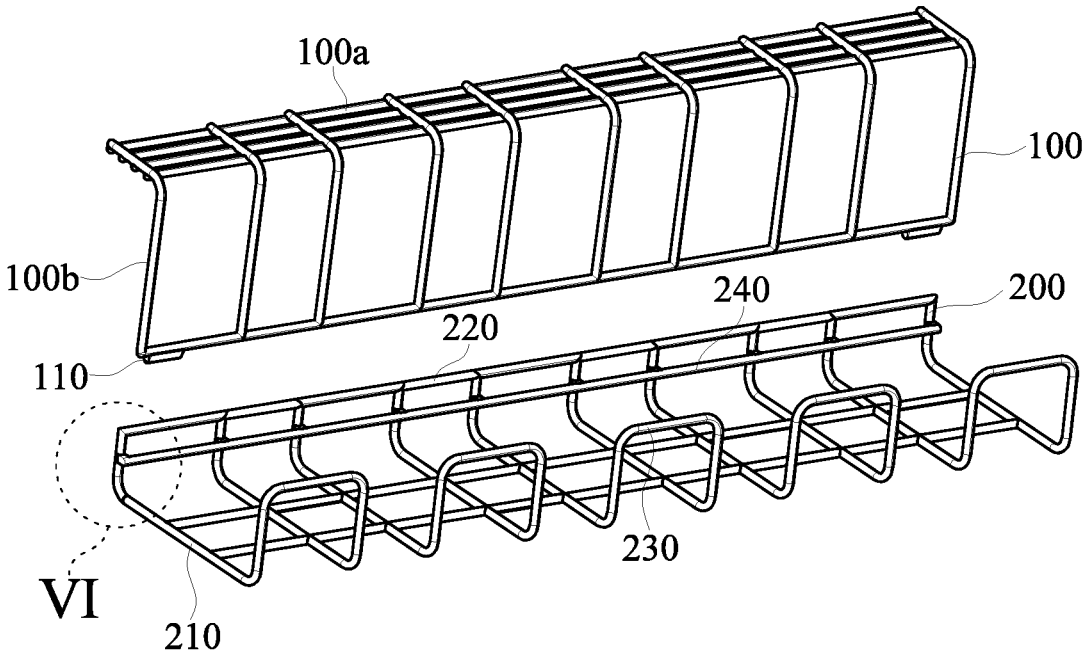
FIG. 5 is a structural explosion schematic diagram of the suspended storage rack.
Figure 6:
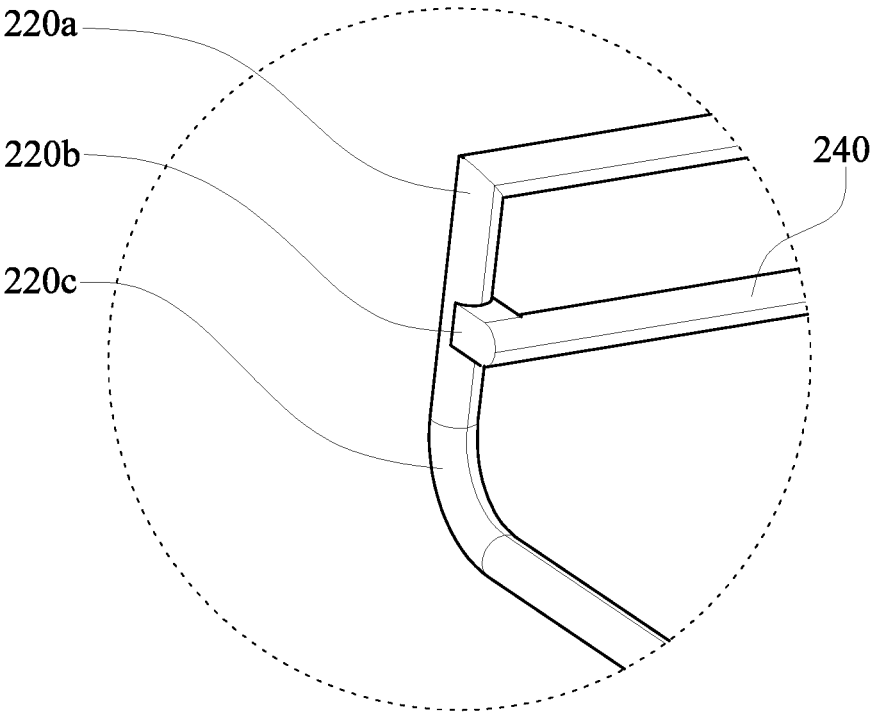
FIG. 6 is the enlarged view of VI place in FIG. 5.

The second rack body 200 includes: a storage part 210 and a first limiting part 220 arranged on one side of the storage part 210 and tilted upward. As shown in FIGS. 5 and 6, a middle part 220*b* of the first limiting part 220 in the vertical direction is hingedly connected to the lower side of the first rack body 100. An upper part 220*a* of the first limiting part 220 in the vertical direction is used to prevent the second rack body 200 from being excessively expanded relative to the first rack body 100 such that when the storage part 210 is unfolded, it is made to stand up at a set angle, which is convenient for storage. A lower part 220*c* of the first limiting part 220 in the vertical direction is used to make the storage part 210 lean against the first rack body 100 after the second rack body 200 is rotated upward for storage, so that after the second rack body 200 is rotated and stored, the second rack body 200 is not easy to fall.

In this embodiment, as shown in FIG. 5 , a rotating sleeve 110 is disposed on the lower side of the first rack body 100 , and a rotating shaft 240 hinged to the rotating sleeve 110 is disposed in the middle part 220*b* of the first limiting part 220 in the vertical direction. In other embodiments, other hinge structures may also be provided.

As a preferred solution, the first rack body 100 is in an inverted L shape. Such a structure is convenient for the first rack body 100 to be suspended, such as suspending on the edge of a kitchen cabinet, a table, a bed frame, and the like.

In order to allow the storage part 210 to place articles stably, when the second rack body 200 is in the unfolded state, under the action of the upper part 220*a* of the first limiting part 220 in the vertical direction, the storage part 210 is parallel to the horizontal plane 100*a* of the first rack body 100.

Figure 7:
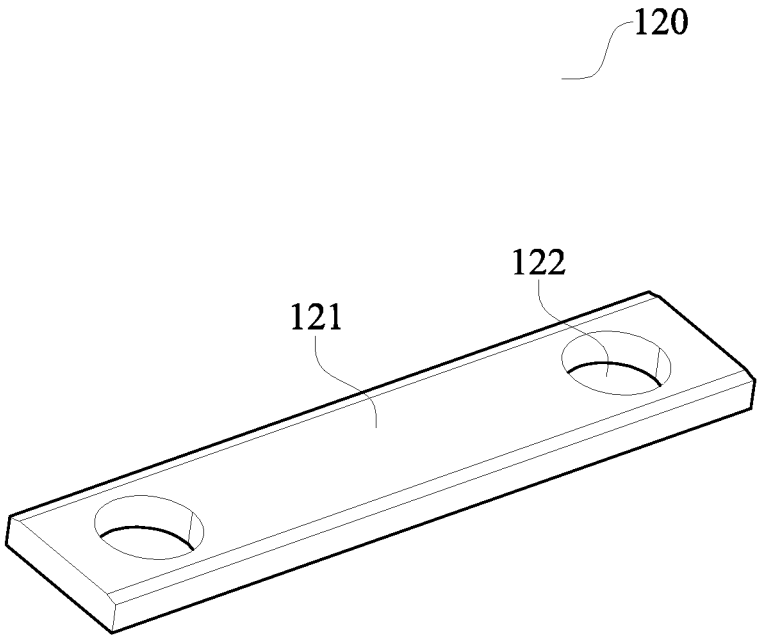
FIG. 7 is a schematic structural diagram of a mounting member in the first embodiment.

As shown in FIG. 1, a mounting member 120 is provided on the horizontal plane 100*a* of the first rack body 100. By providing the mounting member 120, the first rack body 100 can be better fixed and suspended on the edge of the kitchen cabinet, the table, the bed frame, and the like. In this embodiment, as shown in FIG. 7, the mounting member 120 includes: a mounting piece 121 disposed on the lower side of the horizontal plane 100*a* of the first rack body 100; the mounting piece 121 is provided with at least one screw mounting hole 122. In use, the first rack body 100 is suspended on the suspended carrier, and then the first rack body 100 is locked and fixed with screws through the screw mounting holes 122.

As a preferred solution, as shown in FIGS. 1-5, the second rack body 200 further includes: a second limiting part 230 disposed on the other side of the storage part 210 and tilted upward. By providing the second limiting part 230, the articles placed on the storage part 210 can be prevented from falling, and the second rack body 200 can be further turned upward and not easy to fall after being stored. In this embodiment, the second limiting part 230 is provided with a plurality of spaced limiting suspending bars, which can not only prevent the articles from falling, but also suspend some hook-shaped articles, such as clothes hangers.

Furthermore, the second limiting part 230 is perpendicular to the storage part 210.

Furthermore, as shown in FIGS. 3 and 4, the width of the storage part 210 is greater than the height of the first rack body 100. Therefore, when the second part body 200 is rotated upward, it can be stored on the upper side and the outer side of the first part body 100.

In this embodiment, both the first rack body 100 and the second rack body 200 are in a shape of a grid.

Figure 8:
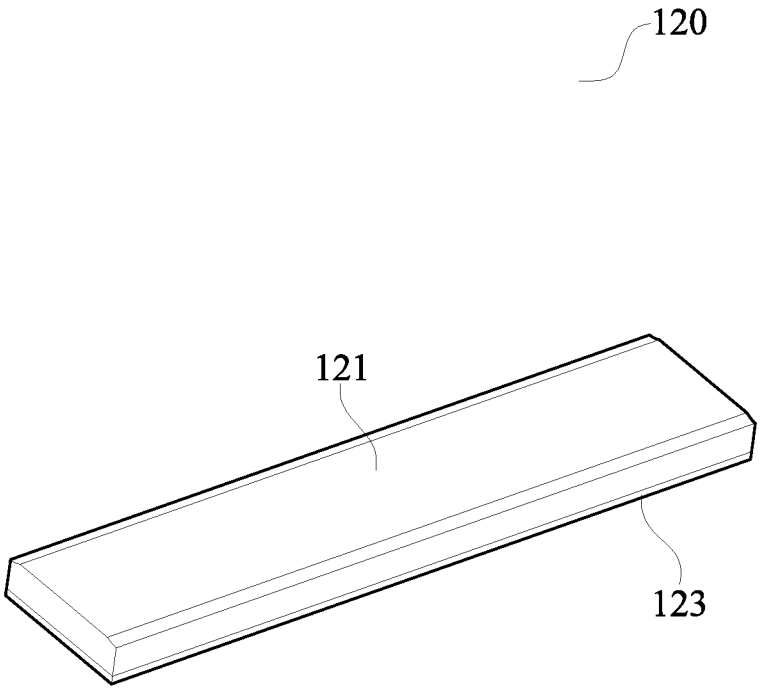
FIG. 8 is a schematic structural diagram of the mounting member in the second embodiment.

Embodiment 2: This embodiment relates to a suspended storage rack, and the difference from Embodiment 1 lies in the mounting member 120. As shown in FIG. 8, in this embodiment, the mounting member 120 includes: a mounting piece 121 disposed on the lower side of the horizontal plane 100*a* of the first rack body 100, and a removable glue 123 disposed on the underside of the mounting piece 121. When in use, the first rack body 100 is suspended on the suspended carrier, and then the first rack body 100 is fixed by the removable glue 123.

The working principle of the present disclosure is roughly as follows. The second rack body 200 is hingedly connected to the lower side of the first rack body 100, and when needed, the second rack body 200 is rotated and opened relative to the first rack body 100, and the second rack body 200 can store articles. When not in use, the second rack body 200 can be directly rotated and stored on the first rack body 100, which is easy to operate and saves space. In addition, the second rack body 200 is provided with a first limiting part 220, and the upper part 220*a* of the first limiting part 220 in the vertical direction is used to prevent the second rack body 200 from being excessively expanded relative to the first rack body 100, such that when the storage part 210 is unfolded, it is made to stand up at a set angle, which is convenient for storage. The lower part 220*c* of the first limiting part 220 in the vertical direction is used to make the storage part 210 lean against the first rack body 100 after the second rack body 200 is rotated upward for storage, so that after the second rack body 200 is rotated and stored, the second rack body 200 is not easy to fall.

The above is only used to illustrate the technical solution of the present disclosure and not to limit it. Other modifications or equivalent replacements made by those of ordinary skill in the art to the technical solutions of the present disclosure should be included in the scope of the claims of the present disclosure as long as they do not depart from the spirit and scope of the technical solutions of the present disclosure.

What is claimed is:

1. A suspended storage rack, comprising: a first rack body (100) for suspending, and a second rack body (200) hingedly connected to a lower side of the first rack body (100) and used for storing articles;

wherein the second rack body (200) includes:

a storage part (210), and a first limiting part (220) arranged on one side of the storage part (210) and tilted upward;

wherein a middle part (220*b*) of the first limiting part (220) arranged in a vertical direction is hingedly connected to the lower side of the first rack body (100);

wherein an upper part (220*a*) of the first limiting part (220) arranged in the vertical direction is used to prevent the second rack body (200) from being excessively expanded relative to the first rack body (100);

wherein a lower part (220*c*) of the first limiting part (220) arranged in the vertical direction is used to make the storage part (210) lean against the first rack body (100) after the second rack body (200) is rotated upward for storage;

wherein a second limiting part (230) is arranged on another side of the storage part (210) and tilted upward, and the second limiting part (230) is provided with a plurality of spaced limiting suspending bars.

2. The suspended storage rack according to claim 1, wherein a rotating sleeve (110) is provided on the lower side of the first rack body (100), and the middle part (220*b*) of the first limiting part (220) arranged in the vertical direction is provided with a rotating shaft (240) hingedly connected to the rotating sleeve (110).

3. The suspended storage rack according to claim 1, wherein the first rack body (100) is in a shape of an inverted L.

4. The suspended storage rack according to claim 3, wherein, when the second rack body (200) is in an unfolded state, the storage part (210) is parallel to a horizontal plane (100*a*) of the first rack body (100).

5. The suspended storage rack according to claim 3, wherein a mounting member (120) is provided on the horizontal plane (100*a*) of the first rack body (100).

6. The suspended storage rack according to claim 5, wherein the mounting member (120) includes: a mounting piece (121) arranged on a lower side of the horizontal plane (100*a*) of the first rack body (100), and the mounting piece (121) is provided with at least one screw mounting hole (122).

7. The suspended storage rack according to claim 5, wherein the mounting member (120) includes: a mounting piece (121) arranged on a lower side of the horizontal plane (100*a*) of the first rack body (100), and a removable glue (123) arranged on a lower side of the mounting piece (121).

8. The suspended storage rack according to claim 1, wherein the second limiting part (230) is perpendicular to the storage part (210).

9. The suspended storage rack according to claim 1, wherein a width of the storage part (210) is greater than a height of the first rack body (100).

10. The suspended storage rack according to claim 5, wherein the second limiting part (230) is perpendicular to the storage part (210).

11. The suspended storage rack according to claim 5, wherein a width of the storage part (210) is greater than a height of the vertical plane (100*b*) of the first rack body (100).

12. The suspended storage rack according to claim 1, wherein the first rack body (100) is in a shape of a grid.

13. The suspended storage rack according to claim 1, wherein the second rack body (200) is in a shape of a grid.

* * * * *